US009222247B2

(12) United States Patent
Muderlak et al.

(10) Patent No.: US 9,222,247 B2
(45) Date of Patent: Dec. 29, 2015

(54) FIXTURE DRAIN INSERT ASSEMBLY

(71) Applicant: Xela Innovations, LLC, Glendale, WI (US)

(72) Inventors: Todd J. Muderlak, Whitefish Bay, WI (US); Kenneth J. Muderlak, Milwaukee, WI (US)

(73) Assignee: XELA INNOVATIONS, LLC, Glendale, WI (US)

( * ) Notice: Subject to any disclaimer, the term of this patent is extended or adjusted under 35 U.S.C. 154(b) by 257 days.

(21) Appl. No.: 13/839,837

(22) Filed: Mar. 15, 2013

(65) Prior Publication Data

US 2014/0259348 A1 Sep. 18, 2014

(51) Int. Cl.

| | |
|---|---|
| ***E03D 13/00*** | (2006.01) |
| ***A47K 11/00*** | (2006.01) |
| *E03C 1/298* | (2006.01) |

(52) U.S. Cl.

CPC ..... *E03D 13/007* (2013.01); *E03C 1/298* (2013.01)

(58) Field of Classification Search

CPC ..... E03C 1/29; E03C 13/00
USPC ..... 4/144.1, 301
See application file for complete search history.

(56) References Cited

U.S. PATENT DOCUMENTS

| | | | | |
|---|---|---|---|---|
| 3,345,023 | A * | 10/1967 | Scott et al. | 248/95 |
| 4,210,309 | A | 7/1980 | Grenier | |
| 4,272,052 | A | 6/1981 | Gidner | |
| 5,604,937 | A | 2/1997 | Davenport | |
| 5,711,037 | A | 1/1998 | Reichardt et al. | |
| 6,286,153 | B1 | 9/2001 | Keller | |
| 6,698,035 | B1 | 3/2004 | Grueser | |
| 6,701,541 | B2 | 3/2004 | Romagna et al. | |
| 6,959,723 | B2 | 11/2005 | Gorges | |
| 7,246,386 | B2 | 7/2007 | Hall | |
| 7,571,741 | B2 | 8/2009 | Higgins | |

(Continued)

FOREIGN PATENT DOCUMENTS

GB 2349568 A * 11/2000

OTHER PUBLICATIONS hybrid H2O HL-28 Urinal; retrieved from url: https://www.sustainablerestroomproducts.com/products/featured-products/hybridh2o-hl-28-waterless-urinal; printed on May 14, 2014; 2 pages.

(Continued)

*Primary Examiner* — Huyen Le
*Assistant Examiner* — Christine Skubinna
(74) *Attorney, Agent, or Firm* — Whyte Hirschboeck Dudek S.C.

(57) ABSTRACT

A fixture drain insert assembly includes a material module support with a securing component; at least one of a trap housing or trap cover comprising an upper surface with a securing component corresponding to the securing component of the material support module, a plurality of drain apertures, and an interlocking structure on the external surface of an inner diameter; a valve; a gasket; and a housing support comprising a body with an open top end having an interlocking structure and an inner lip on the inner surface of the open top end, wherein the interlocking structure corresponds to and mates with the interlocking structure of the trap housing or trap cover. The fixture drain insert assembly can be retrofit into existing fixtures such as urinals to create efficient and clean low water to no-water use fixtures or be integrated into new fixtures with corresponding mating features to optimize fit.

10 Claims, 20 Drawing Sheets

(56) References Cited

U.S. PATENT DOCUMENTS

| | | | | |
|---|---|---|---|---|
| 7,636,957 | B2 | 12/2009 | Funari | |
| 7,900,288 | B2 | 3/2011 | Fima | |
| 8,122,795 | B2 * | 2/2012 | Goll | 82/1.11 |
| 8,231,865 | B2 | 7/2012 | Pliszka | |
| 8,234,723 | B2 | 8/2012 | Allen | |
| 8,291,522 | B2 | 10/2012 | Kueng | |
| 8,322,682 | B2 | 12/2012 | Maercovich | |
| 2010/0138985 | A1 * | 6/2010 | Duncan | 4/287 |
| 2010/0205725 | A1 * | 8/2010 | McAlpine | 4/144.1 |
| 2012/0117719 | A1 | 5/2012 | Brooks | |
| 2012/0317707 | A1 * | 12/2012 | Romero | 4/144.1 |
| 2013/0031708 | A1 | 2/2013 | Sensel | |

OTHER PUBLICATIONS hybrid H2O featured products; retrieved from url: https://www.sustainablerestroomproducts.com/featured-products; printed on Jul. 24, 2013; 2 pages.

hybrid H2O Waterless Urinal Replacement Cartridges; retrieved from url: https://www.sustainablerestroomproducts.com/waterless-urinal-replacement-cartridges; printed on Jul. 24, 2013; 2 pages.

hybrid H2O Waterless Urinal Accessories; retrieved from url: https://www.sustainablerestroomproducts.com/waterless-urinal-accessories; printed on Jul. 24, 2013; 2 pages.

hybrid H2O "Waterless or Water . . . You Choose!" Specification Sheet; Apr. 2013; 2 pages.

* cited by examiner

FIXTURE DRAIN INSERT ASSEMBLY

FIELD

The present disclosure relates to fixture drain inserts, and more specifically to inserts that contain one of many trap assemblies for fixture drains.

BACKGROUND

Water conservation is a major concern in many areas and is likely to become even more important in the future as populations increase resulting in more water consumption. Practicing water conversation on a regular basis has many benefits including saving money both in the short term and long term. In the short term, water conservation saves the consumer money by reducing a consumer's monthly water utility bill. In the long term, consumers save money by postponing, or even preventing, the building of new water supply infrastructures, thereby reducing the per unit cost (or slowing the increase in cost) of water.

The bathroom is one area where water is often needlessly used. In fact, the largest daily user of water in the commercial establishments is the urinal and in homes is the toilets. To conserve water use, low water use urinals and no-water urinals and other fixtures have been devised. These no-water urinals are not flushed with water each time a person uses the urinal and, in fact, they are not equipped for flushing as they are not connected to a water supply. As the no-water urinal is repeatedly used, most urine is collected in a compartment of the urinal while some passes through the drain. An oily sealing liquid that is immiscible with the urine and is lighter than the urine covers the collected urine. This oily sealing liquid floats on the surface of the urine, serving as a barrier that prevents odors from the urinal from escaping to the environment. Typically, such no-water urinals include a removable cartridge having a top with an opening in communication with the compartment holding an initial water charge that mixes with urine flowing into the compartment through the opening. A stand pipe type drain is in communication with the compartment that allows the compartment to be drained continually to a sewer or other waste disposal system as the compartment is filled with urine. Dry traps using mechanical valve or small p-traps are also used to prevent odor from escaping while still allowing urine to pass.

A disadvantage of these no-water urinals is that the urinals are specially designed to accept these removable cartridges. For an institution to convert from water-based urinals to no-water urinals requires the complete replacement of the existing water-based urinals. This can be an expensive and time-consuming process.

It is desirable to provide a fixture drain insert which may be used in present water-based urinals to convert the urinals to low-water or no-water based urinals.

It is desirable to provide a fixture drain insert which may be used with existing traps and fixtures to permit the passage of used fluids and urine while preventing sewer gas from escaping.

BRIEF SUMMARY

In at least one embodiment, a fixture drain insert assembly is provided that includes a material module support comprising a bottom surface with a securing component; at least one of a trap housing or trap cover comprising an upper surface with a securing component corresponding to the securing component of the material support module, wherein the trap housing or trap cover further includes a plurality of drain apertures, an inner diameter with an external surface, and an interlocking structure on the external surface of the inner diameter; a valve; a gasket; and a cylindrical housing support comprising a cylindrical body with an open top end, the open top end comprising an interlocking structure and an inner lip on the inner surface of the open top end, wherein the interlocking structure corresponds to and mates with the interlocking structure of the trap housing or trap cover.

In at least another embodiment, a fixture drain insert assembly is provided comprising a material support module comprising a cover and a bottom configured to secure together to house a material selected from the group consisting of a fragrance material, an enzyme and/or bacteria material, a cleaning material, and combinations thereof, and a female securing component on the bottom surface of the bottom; a trap housing comprising a sloped upper surface containing a plurality of drain apertures and a central male securing component corresponding to the female securing component of the material support module, an inner diameter containing a plurality of interlocking L-shaped protuberances on an outer surface of the inner diameter, and a plurality of pin interlocking structures around an outer surface of the housing; a housing support comprising an open end containing an inner lip and a plurality of protuberances on an inner surface of the open end, wherein the plurality of pin protuberances correspond to the plurality of interlocking L-shaped protuberances on the inner diameter of the trap housing, wherein the L-shaped protuberances of the inner diameter and the pin protuberances of the housing support are configured to matingly join as a bayonet mount, and a cylindrical body; a valve secured between the housing support and the trap housing and projecting to the housing support; and a drain mounting component comprising a plurality of L-shaped interlocking structures corresponding to the pin interlocking structures around the outer surface of the housing, wherein the L-shaped protuberances of the drain mount and the pin protuberances of the trap housing are configured to matingly join as a bayonet mount.

In at least another embodiment, a fixture drain insert assembly is provided comprising a material support module comprising a cover and a bottom configured to secure together to house a material selected from the group consisting of a fragrance material, an enzyme and/or bacteria material, a cleaning material, and combinations thereof, and a female securing component on the bottom surface of the bottom; a trap cover comprising a sloped upper surface containing a plurality of drain apertures and a central male securing component corresponding to the female securing component of the material support module, an inner diameter containing a plurality of interlocking L-shaped protuberances on an outer surface of the inner diameter, and a plurality of legs; a housing support comprising an open end containing an inner lip and a plurality of protuberances on an inner surface of the open end, wherein the plurality of pin protuberances correspond to the plurality of interlocking L-shaped protuberances on the inner diameter of the trap housing, wherein the L-shaped protuberances of the inner diameter and the pin protuberances of the housing support are configured to matingly join as a bayonet mount, and a ridge; a drain cover skirt secured between the housing support component and the trap cover; a valve secured between the housing support and the trap cover and projecting into the housing support; and a gasket secured in the ridge of the housing support component.

Other embodiments, aspects, features, objectives and advantages of the hygiene product disposal apparatus and method of use will be understood and appreciated upon a full reading of the detailed description and the claims that follow.

BRIEF DESCRIPTION OF THE DRAWINGS

Embodiments of the fixture drain insert assembly are disclosed with reference to the accompanying drawings and are for illustrative purposes only. The fixture drain insert assembly is not limited in its application to the details of construction or the arrangement of the components illustrated in the drawings. The fixture drain insert assembly is capable of other embodiments or of being practiced or carried out in other various ways. In the drawings.

DETAILED DESCRIPTION

Figure 1:
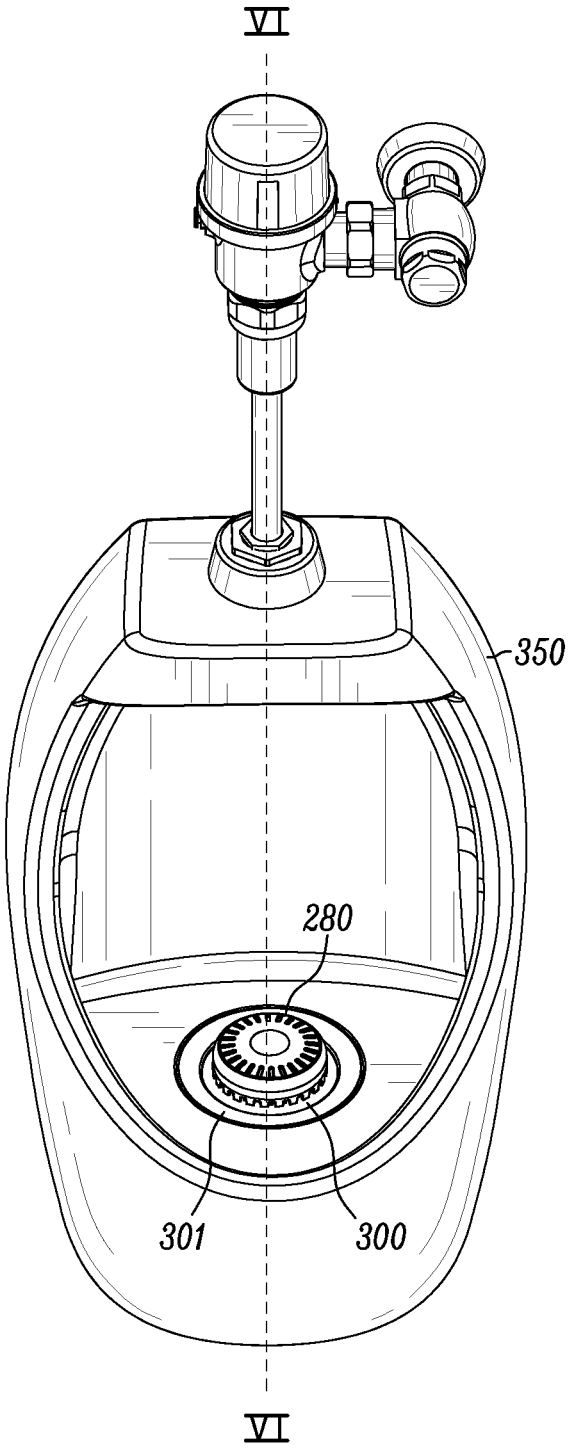
FIG. 1 illustrates a perspective view of an embodiment of a fixture drain insert assembly inserted in a urinal.

FIG. 1 illustrates a perspective view of an embodiment of a fixture drain insert assembly 300 with material support module 280 inserted in a urinal 350. While in the exemplary embodiments described herein, fixture drain insert assembly 300 is described in the context of urinal drains, it is to be understood that fixture drain insert assembly 300 may be used with other fixtures, such as sinks.

Figure 2:
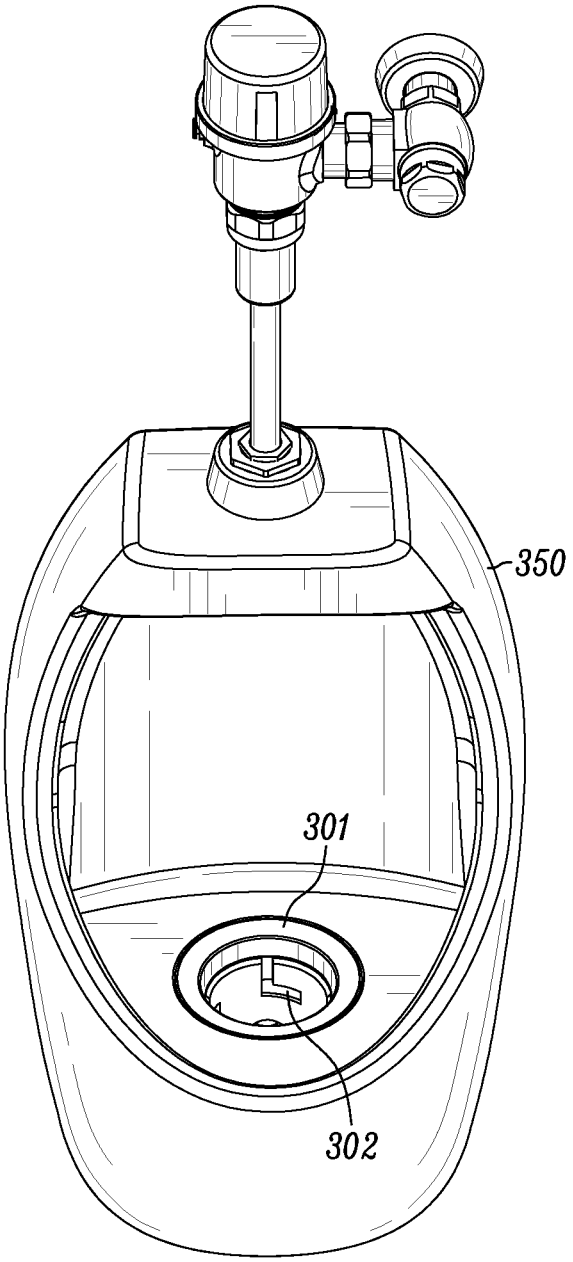
FIG. 2 illustrates a perspective view of drain mounting component in a urinal for securing the fixture drain insert assembly shown in FIG. 1.

FIG. 2 illustrates a perspective view of urinal 350 with drain mounting component 301. Drain mounting component 301 fits within the urinal drain and contains interlocking members 302 which engage protuberances 241 of trap housing 240 (see FIG. 4) in a bayonet mount style. Other forms of securing trap housing 240 to drain mounting component 301 may be used however, such as threaded structures, friction fit components, and other attachment structures and assemblies known in the art.

Figure 3:
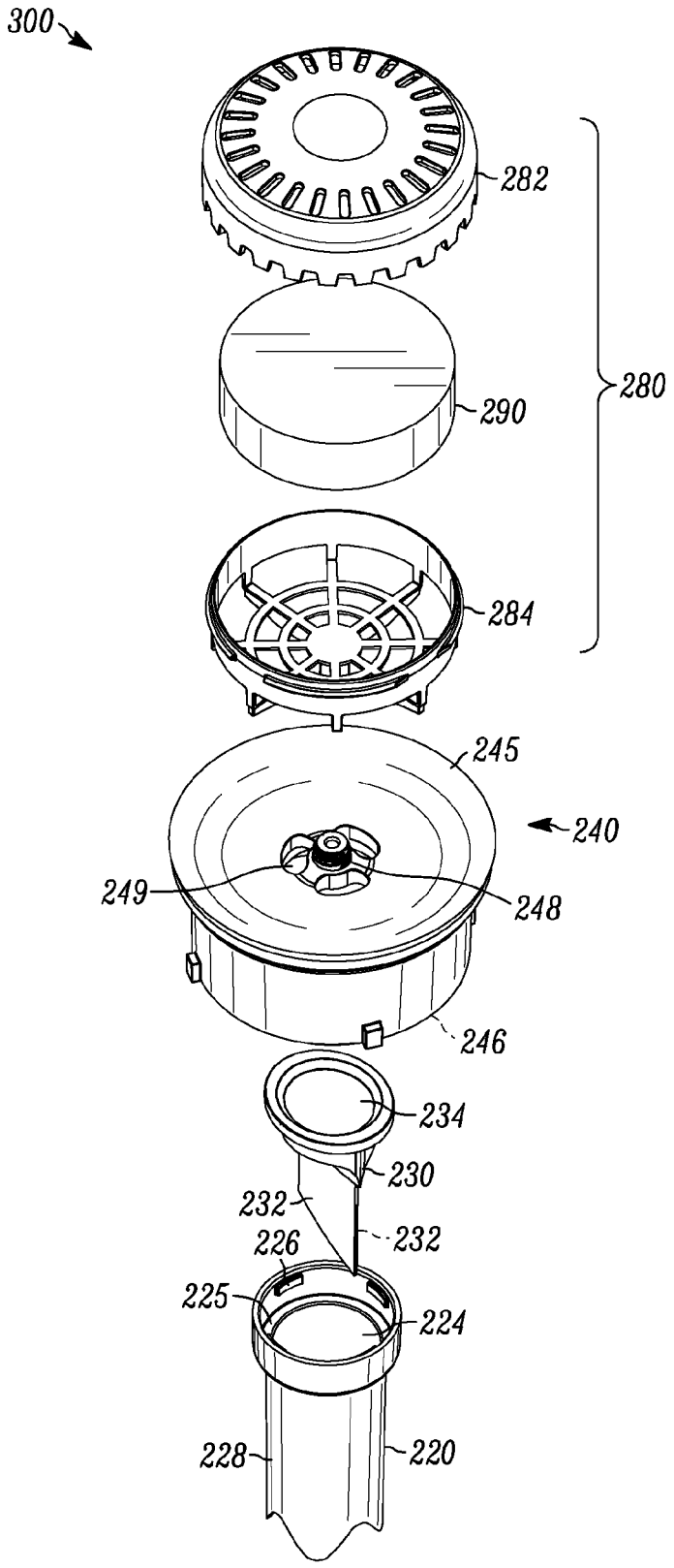
FIG. 3 illustrates an exploded view of the fixture drain insert assembly.

FIG. 3 illustrates an exploded view of the fixture drain insert assembly 300 shown in FIG. 1. Material support modules 280 comprises cover 282 and bottom 284 which secure together to enclose fragrance or enzyme/bacteria material 290. In the exemplary embodiment shown, material 290 is a solid block containing a fragrance or enzyme/bacteria or other cleaning agent. In further exemplary embodiments, material 290 could be a gel or liquid.

Bottom 284 of material support module 280 includes securing component 288 (shown in FIG. 5) on its bottom surface. Securing component 288 connects and secures material support module 280 to trap housing 240. Trap housing 240 has a corresponding securing component 248 at the center of sloped upper surface 245 which engages securing component 288 of material support module 280. In the exemplary embodiment shown, securing component 248 is a threaded male member which threadingly engages securing component 288, which is a threaded female member. However, in further exemplary embodiments, material support module 280 and trap housing 240 may secure to each other through any means known in the art. Sloped upper surface 245 is sloped downwardly towards drain apertures 249 which permit the passage of liquid through trap housing 240 and the rest of fixture drain insert assembly 300.

The inner bottom surface of trap housing 240 includes an interlocking structure 246 (shown in more detail in FIG. 5), which, in the exemplary embodiment described, is a plurality of L-shaped protuberances oriented radially around the outer surface of an inner diameter 247 (not shown) of trap housing 240. Interlocking structure 246 engages corresponding interlocking structure 226 of housing support 220. As shown in FIG. 3, corresponding interlocking structure 226 comprises a plurality of pin protuberances radially configured around the inner surface of open top end 224. When housing support 220 and trap housing 240 are secured together, open top end 224 slides over inner diameter 247 of trap housing 240 when interlocking structures 246 and 226 of offset relative to each other. Once interlocking structures 246 and 226 are past each other, trap housing 240 and housing support 220 are rotated relative to one another to align interlocking structures 246 and 226 such that the pin interlocking structures 226 are secured against the L-shaped protuberances 246. This style of joining is called a bayonet mount, which is easy to engage and disengage for quick and easy joining/removal of trap housing 240 from housing support 220.

In further exemplary embodiments, any structure, mechanism or combination thereof may be used to join trap housing 240 and housing support 220. For example, trap housing 240 and housing support 220 could be joined by interlocking threaded components, adhesives or sonic welding. However, using a form of interlocking components, such as the bayonet mount or threads, provides a quick and easy way to remove fixture drain insert assembly 300 components for cleaning, replacement or repair. It also makes accessing the trap and valve easy without having to remove the entire fixture drain insert assembly 300 from the fixture.

As illustrated in FIG. 3, housing support 220 also includes a smooth cylindrical body 228 for insertion into a fixture drain. In other embodiments, cylindrical body 228 may be threaded or have a different shape to conform or secure to a given drain/trap style.

Fixture drain insert assembly 300 also includes elastomer trap 230 which has an open top end 234 configured to sit on inner lip 225 of housing support 220. Open top end 234 of elastomer trap 230 provides a passage for liquid from trap housing 240 into housing support 220 (and therefore a fixture drain) through flaps 232. While two flaps 232 are shown, other exemplary embodiments may use more flaps 232. When urinal drain insert assembly 300 is assembled, the joining of housing support 220 and trap housing 240 secures elastomer trap 230 between them.

Figure 4:
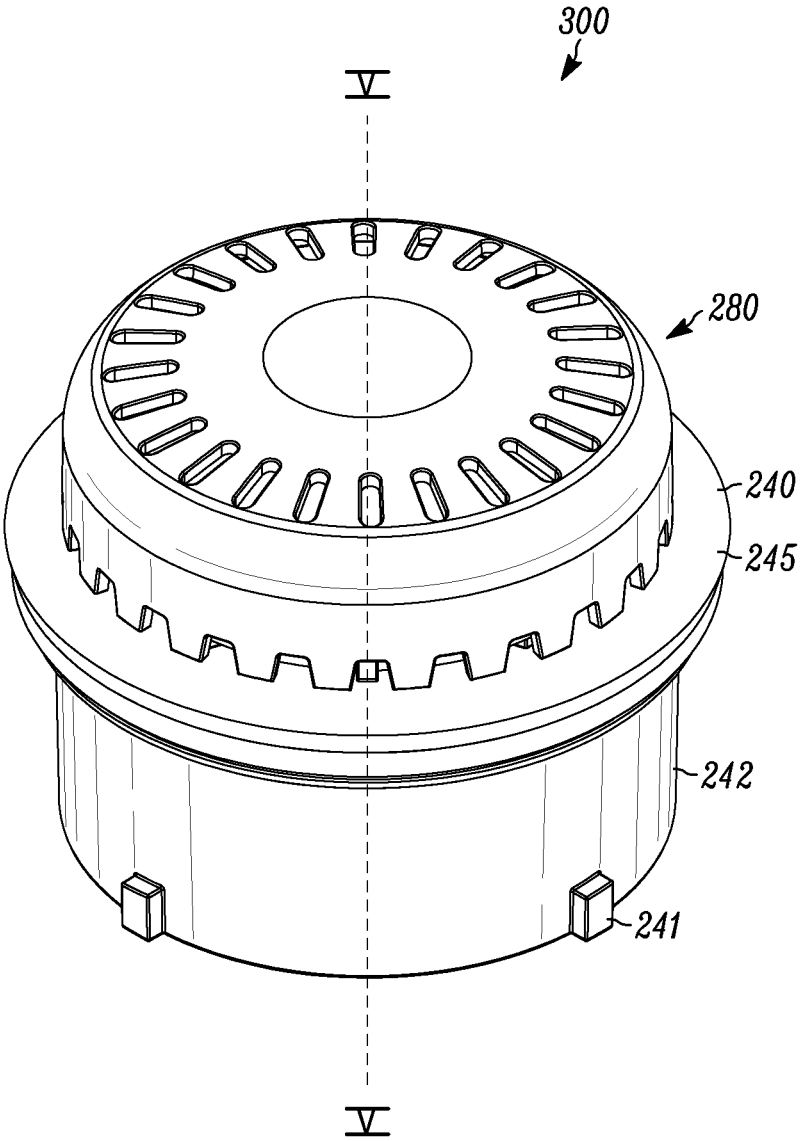
FIG. 4 illustrates a side perspective view of the fixture drain insert assembly of FIG. 1.

FIG. 4 illustrates a side perspective view of the fixture drain insert assembly 300. Material support module 280 is assembled and secured to trap housing 240 with sloped upper surface 245 extending beyond material support module 280. Trap housing 240 has cylindrical outer surface 242 with protuberances 241 for securing in a fixture drain.

Figure 5:
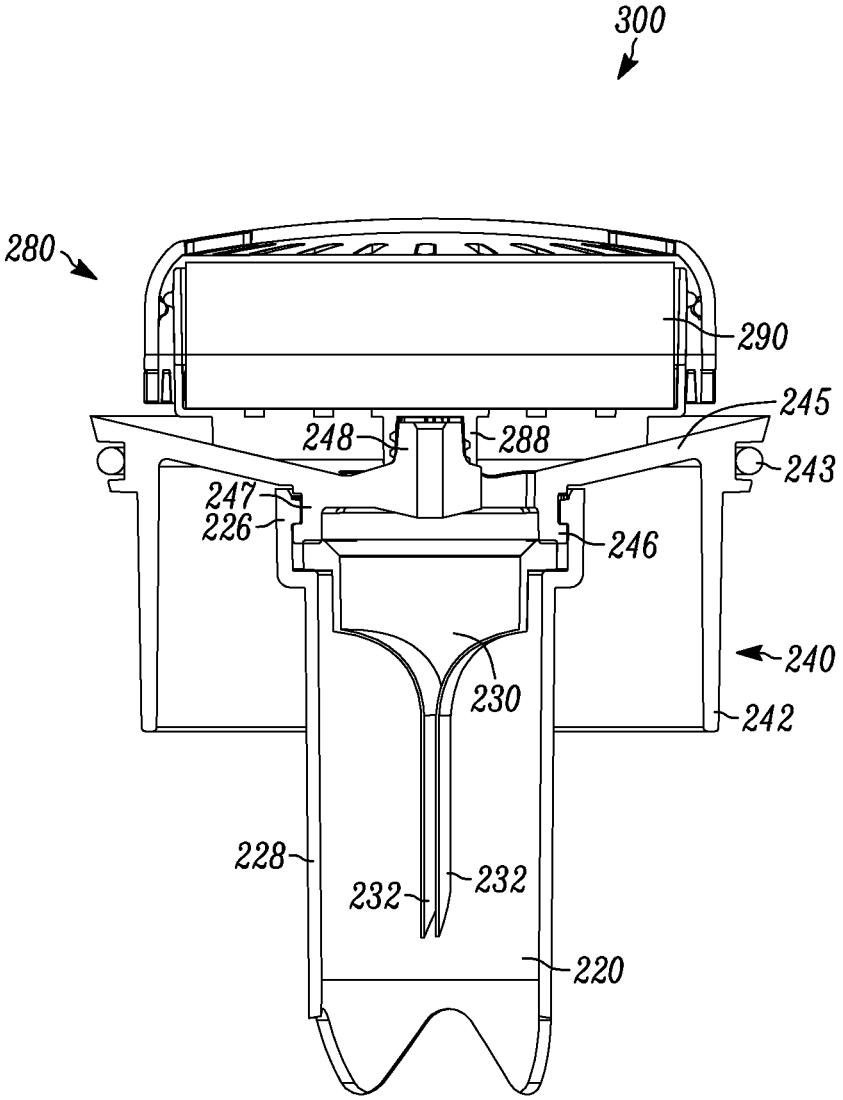
FIG. 5 illustrates a cross-sectional view of the fixture drain insert assembly taken along the line V-V of FIG. 4.

FIG. 5 illustrates a cross-sectional view of the fixture drain insert assembly 300 taken along the line V-V of FIG. 4. Material support module 280 contains fragrance or enzyme/bacteria material 290 and is secured to trap housing 240 at securing components 248 (on trap housing) and 228 (on material support module 280). As illustrated, male securing component 248 is securely threaded into female securing component 288.

The mating of interlocking structures 246 (on inner diameter 247 of trap housing 240) and 226 on housing support 220 is also shown. Interlocking structures 246 and 226 are aligned to engage one another and connected as in a bayonet mount, described above. Elastomer trap 230 with two flaps 232 is secured between trap housing 240 and housing support 220. Trap housing 240 also contains gasket 243 which helps create a seal around a fixture drain.

Figure 6:
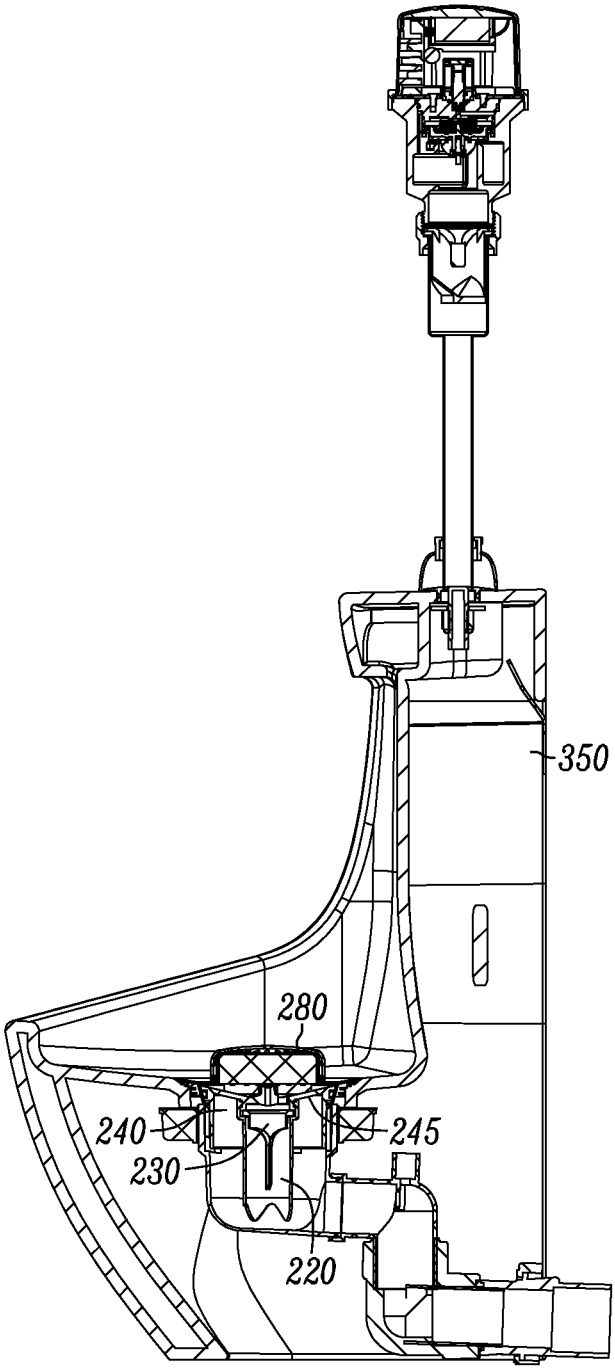
FIG. 6 illustrates a cross-sectional view of the fixture drain insert assembly inserted in a urinal drain taken along the line VI-VI of FIG. 1.

FIG. 6 illustrates a cross-sectional view of the fixture drain insert assembly 300 inserted in a urinal 350 taken along the line VI-VI of FIG. 1. Material support module 280 projects into the basin of urinal 350 and is visible. Trap housing 240 is secured within the urinal's drain with sloped upper surface 245 concealed in the drain beneath material support module 280. Housing support 220 projects downward into the urinal trap with elastomer trap 230 secured between housing support 220 and trap housing 240.

In the exemplary embodiment shown, as liquid (i.e., water, urine, etc.) flows enters the urinal basin, the liquid passes through drain apertures 249 of trap housing 240, through elastomer trap 230 and out housing support 220. Elastomer trap 230 acts as a one-way valve permitting only the passage of liquid downward through its flaps 232 and preventing the backup of liquid or gas through elastomer trap 230. Trap housing 240 further prevents gases and liquids from escaping back up the urinal drain.

Figure 7:
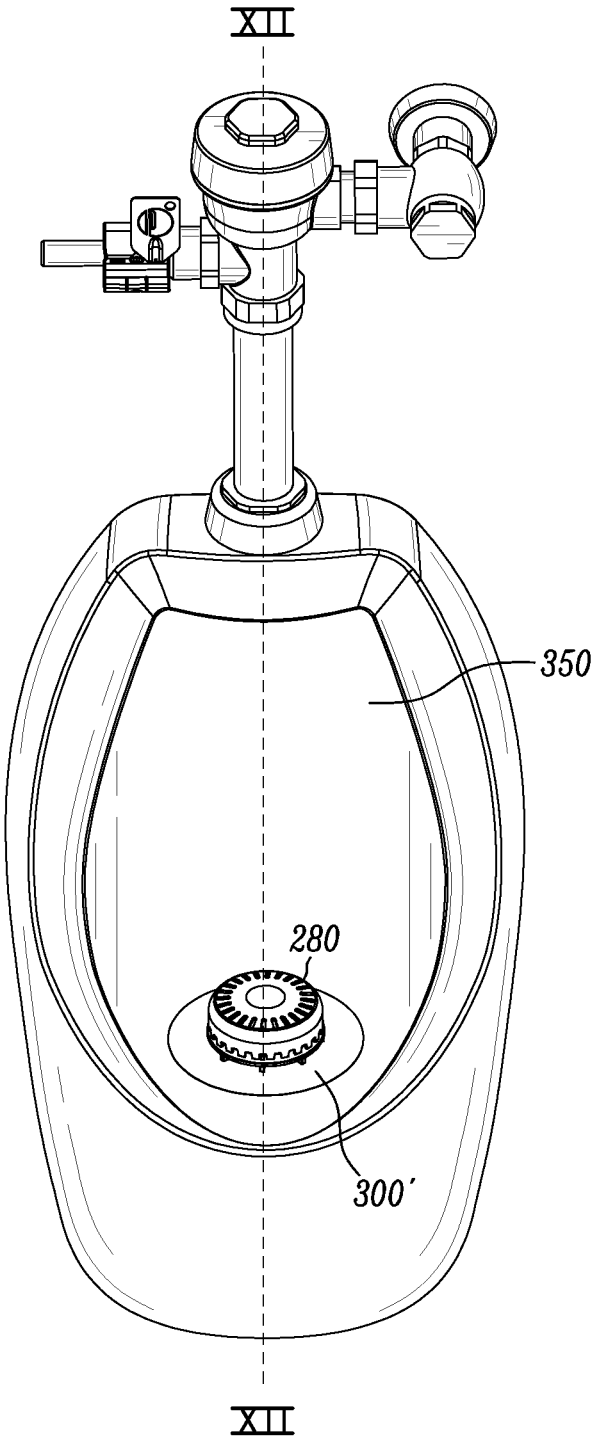
FIG. 7 illustrates a perspective view of another embodiment of a fixture drain insert assembly inserted in a urinal drain.

FIG. 7 illustrates a perspective view of another embodiment of a fixture drain insert assembly 300' with material support module 280 inserted in a urinal 350. In the exemplary embodiment shown in FIGS. 7-11, fixture drain insert assembly 300' is designed to retrofit into any existing fixture drain.

Figure 8:
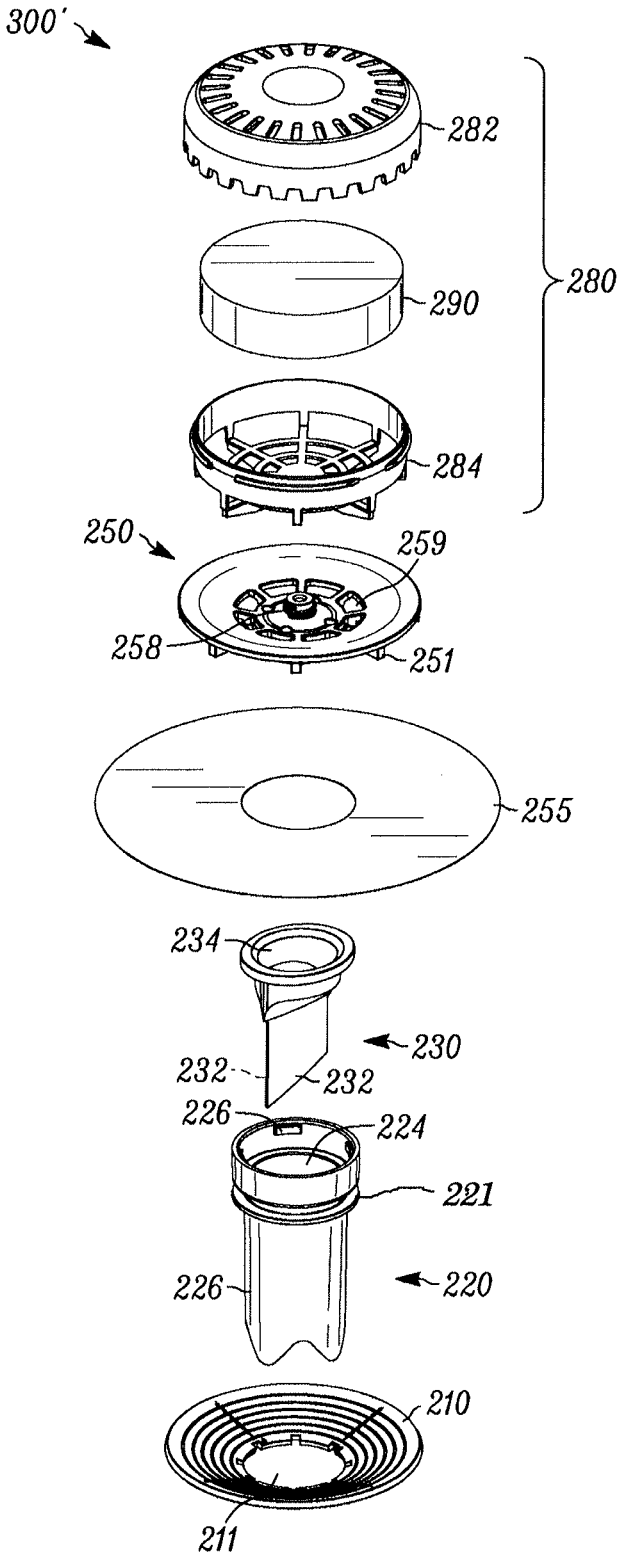
FIG. 8 illustrates an exploded view of the fixture drain insert assembly of FIG. 7.
Figure 11:
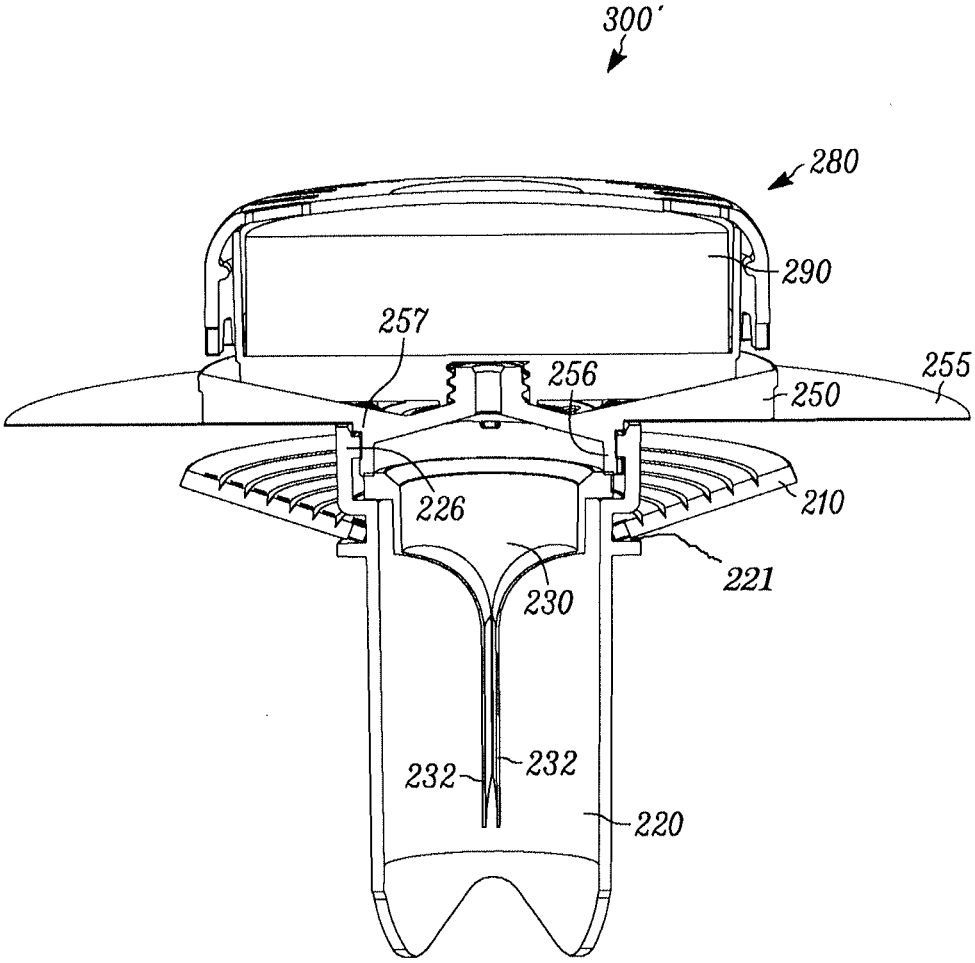
FIG. 11 illustrates a cross-sectional view of the fixture drain insert assembly taken along the line XI-XI of FIG. 10.

FIG. 8 illustrates an exploded view of the fixture drain insert assembly 300' of FIG. 7. Material support module 280 comprises cover 282 and bottom 284 which secure together to house material 290. In place of trap housing 240, however, fixture drain insert assembly 300' comprises trap cover 250 which secures to support module 280 through the connection of securing components 288 (on support module 280) and 258 (on trap cover 250). Like trap housing 240, trap cover 250 includes an inner diameter 257 which contains an interlocking structure 256 which corresponds to interlocking structure 226 of housing support 220, as shown in FIG. 11. Trap cover 250 also contains legs 251 which keep trap cover with drain apertures 259 slightly raised over drain cover skirt 255. Drain cover skirt 255 is a flexible piece of material that does not interact with most liquids exposed in urinals (such as a polymeric based material, silicone, thermoplastic elastomers, thermoplastic olefinic elastomers, etc.) which conforms to a fixture to seal around a drain. Drain cover skirt 255 functions to further ensure no odor escapes the drain and helps ensure that urine/liquids pass through drain apertures 259 and, ultimately, elastomer trap 230.

Fixture drain insert assembly 300' also includes elastomer trap 230 which has two flaps 232 and an open top end 234 which provides passage of liquid from trap cover 250 through housing support 220 and is designed to rest on inner lip 225 of housing support 220. Housing support has interlocking structure 226 which corresponds to interlocking structure 256 of trap cover 250 and cylindrical body 228. In the exemplary embodiment shown, cylindrical body 228 includes ridge 221 for seating gasket 210. Inner edge 211 of gasket 210 secures in ridge 221 to connect gasket 210 to housing support 220. Gasket 210 creates an odor seal for fixture drain insert assembly 300'.

Figure 9:
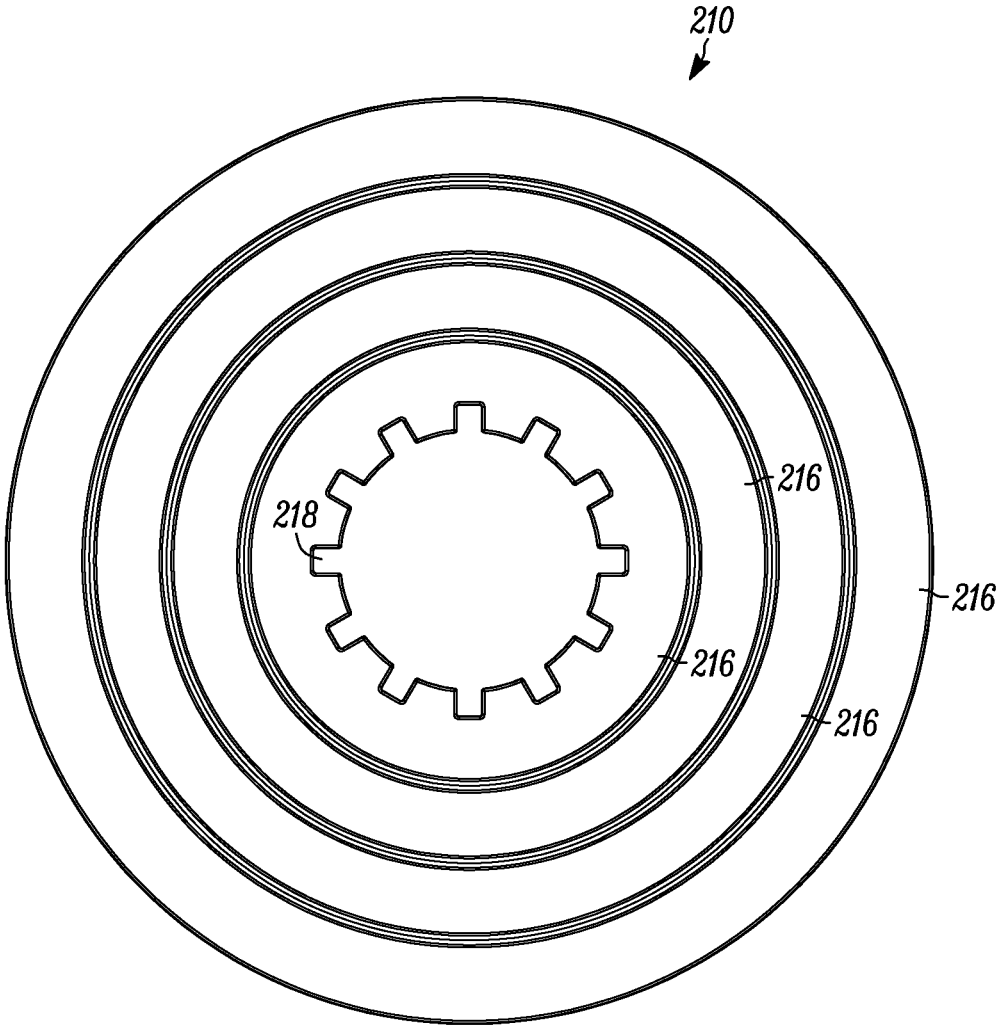
FIG. 9 illustrates the gasket of the fixture drain insert assembly shown in FIG. 8.

FIG. 9 illustrates a top view of gasket 210. Gasket 210 includes a plurality of removable concentric rings, allowing gasket 210 to be sized to any existing drain or trap style and still create a seal to prevent odors from escaping. Gasket 210 also includes drain apertures 218 which permit liquid to flow past gasket 210 if it should leak past drain cover skirt 255. Gasket 210 also serves to help secure fixture drain insert assembly 300' in the drain and prevent movement.

Figure 10:
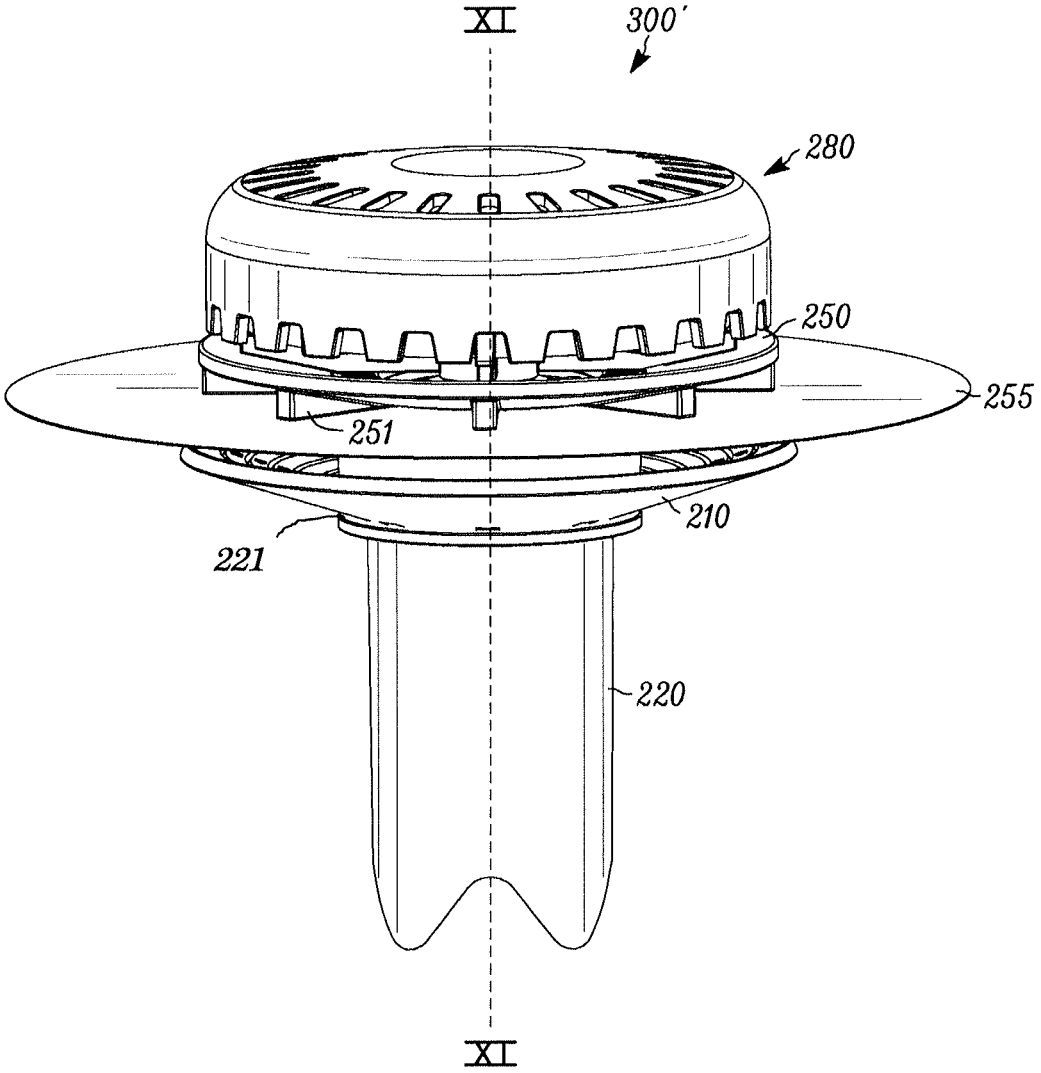
FIG. 10 illustrates a perspective view of the fixture drain insert assembly.

FIG. 10 illustrates a perspective view of the fixture drain insert assembly 300'. Material support module 280 is assembled and secured to trap cover 250. Legs 251 hold trap cover 250 up from drain cover skirt 255, with gasket 210 secured to housing support 220.

FIG. 11 illustrates a cross-sectional view of the fixture drain insert assembly 300' taken along the line XI-XI of FIG. 10. Material support module 280 contains material 290, which may be a block, gel or liquid material containing a fragrance, enzyme/bacteria or other cleaning/deodorizing agent. Material support module 280 is secured to trap cover 250 at securing components 258 and 288. In the embodiment shown, securing component 288 (on material support module 280) is a threaded female component into which securing component 258 (on trap cover 250), a threaded male component, is threaded. Other securing structures, however, may be used.

Trap cover 250 with interlocking structures 256 on inner diameter 257 are joined with corresponding interlocking structures 226 on housing support 220 in a bayonet mount style. Elastomer trap 230 with two flaps 232 is secured between trap cover 250 and housing support 220, and drain cover skirt 255 is secured around inner diameter 257 of trap cover 250.

Figure 12:
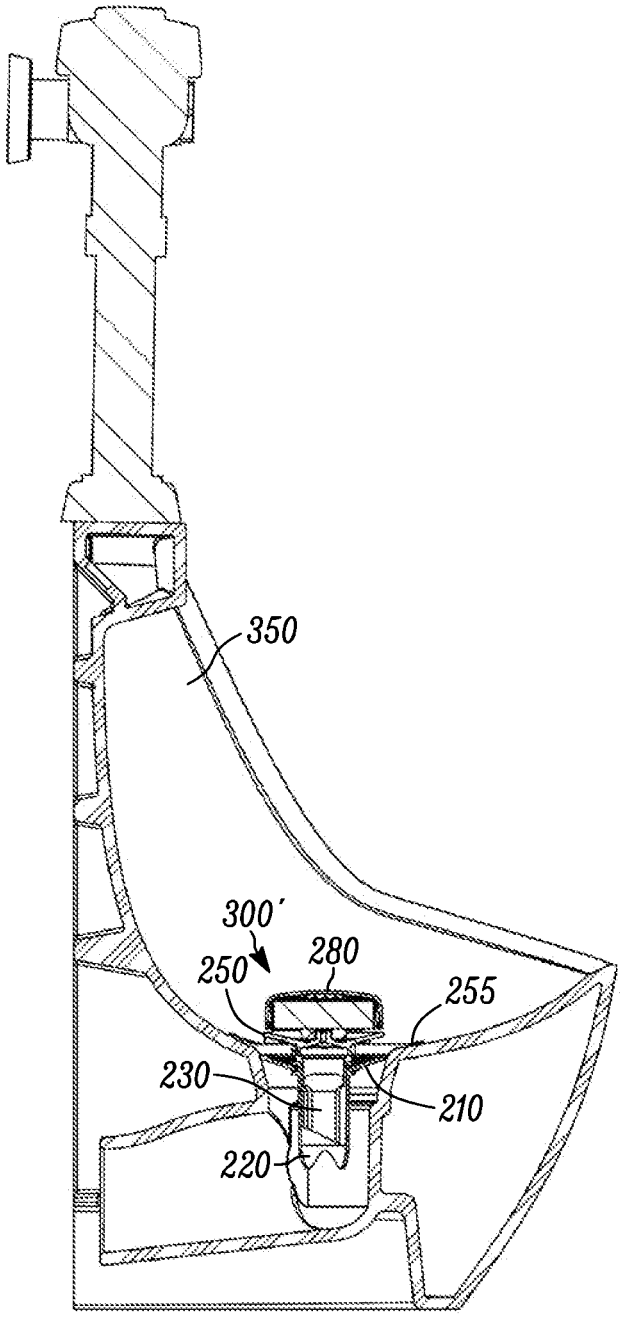
FIG. 12 illustrates a cross-sectional view of the fixture drain insert assembly inserted in a urinal drain taken along the line XII-XII of FIG. 7.

FIG. 12 illustrates a cross-sectional view of the fixture drain insert assembly 300' inserted in a urinal 350 taken alone the line XII-XII of FIG. 7. Material support module 280 projects into the basin of urinal 350 and is visible. Trap cover is secured underneath material support module 280 outside of the urinal drain with drain cover skirt 255 creating a liquid seal around the drain. Gasket 210, secured to housing support 220, creates a gas tight seal from under the urinal drain. Elastomer trap 230 is secured between housing support 220 and trap cover 250.

In the exemplary embodiment shown, as liquid (i.e., water, urine, etc.) flows enters the urinal basin, the liquid passes through drain apertures 259 of trap cover 250, through elastomer trap 230 and out housing support 220. Elastomer trap 230 acts as a one-way valve permitting only the passage of liquid downward through its flaps 232 and preventing the backup of liquid or gas through elastomer trap 230. Gasket 210 and drain cover skirt 255 further prevents gases and liquids from escaping back up the urinal drain. Drain cover skirt 255 also directs liquids to drain apertures 250 of trap cover 250 so that the liquids (i.e., urine, water) are directed through elastomer trap 230.

Figure 13:
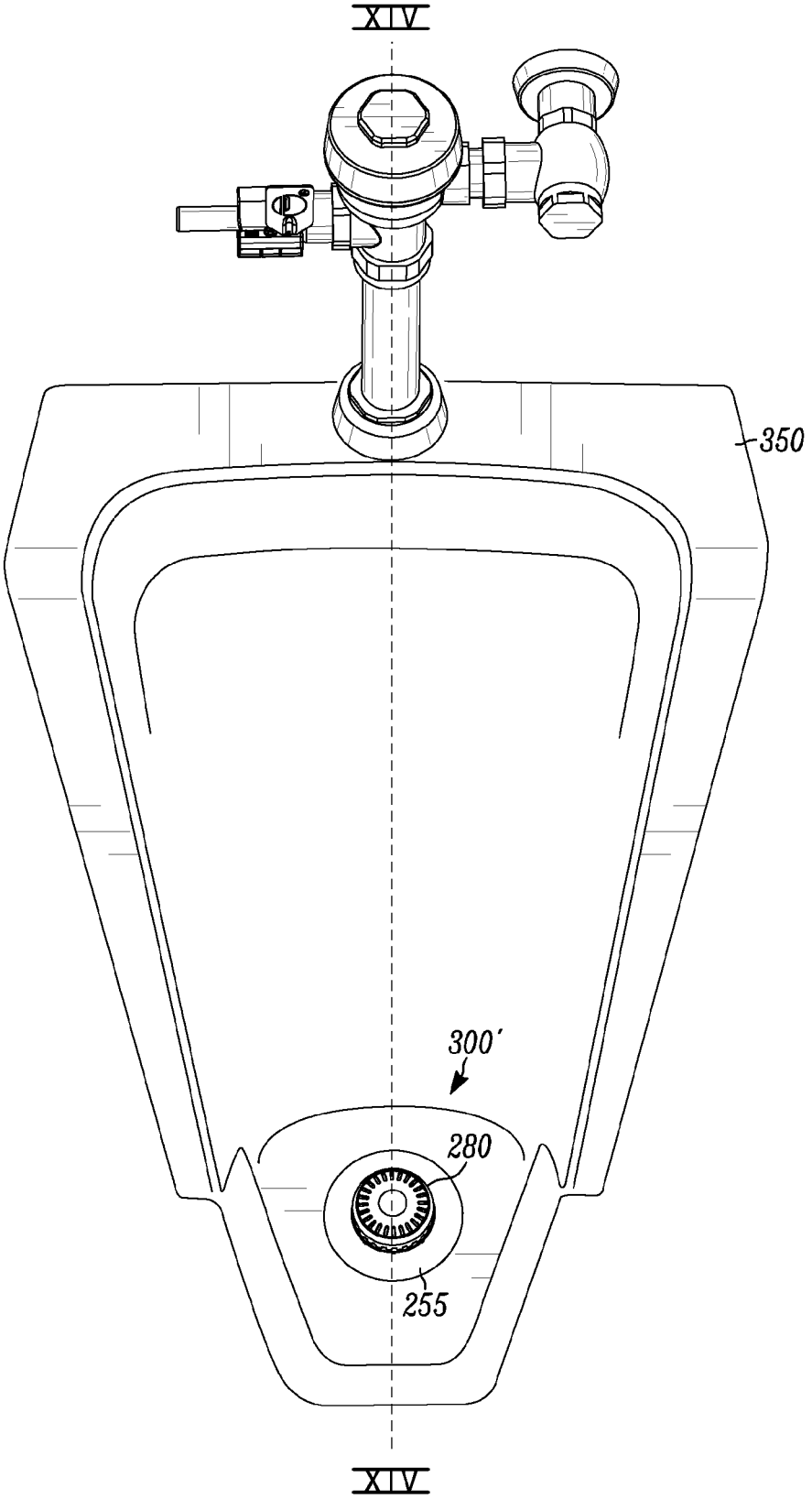
FIG. 13 illustrates a perspective view of the fixture drain insert assembly inserted in a floor mounted urinal.
Figure 14:
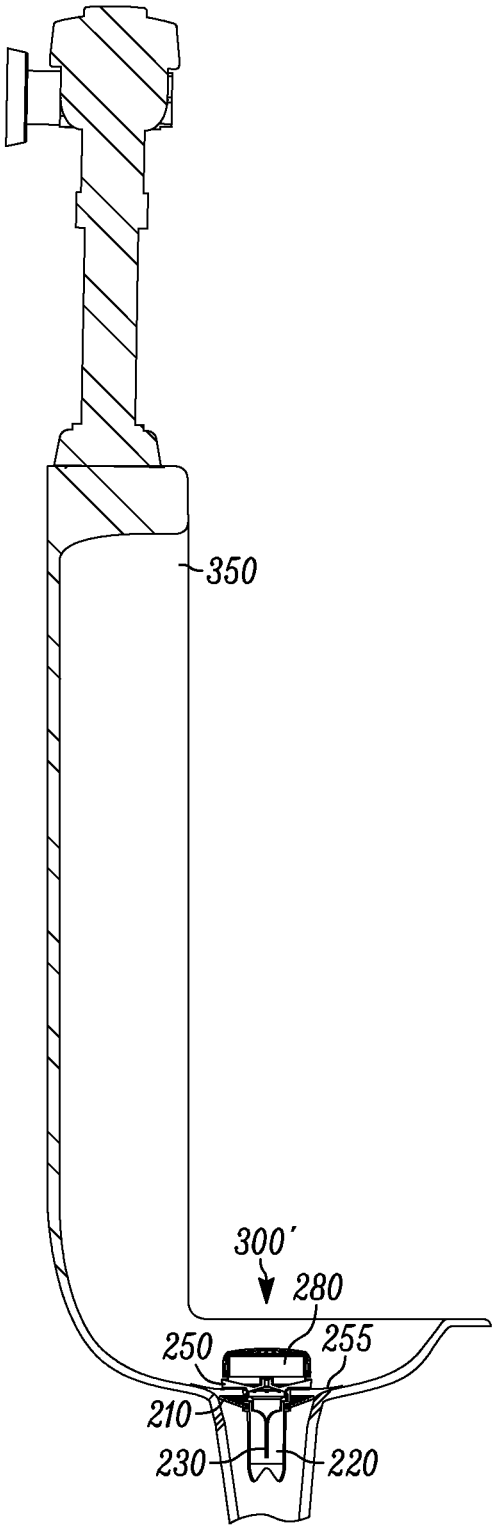
FIG. 14 illustrates a cross-sectional view of the fixture drain assembly inserted in a floor mounted urinal taken along the line XIV-XIV of FIG. 13.

While in the exemplary embodiments above fixture drain insert assembly 300/300' have been shown in use with wall-mounted urinals, fixture drain insert assemblies 300/300' may be used with other fixtures, including, but not limited to, floor mounted urinals, such as depicted in FIGS. 13-14. FIGS. 13-14 illustrate fixture drain insert assembly 300' with material support module 280 and drain cover skirt 255 secured in a floor mounted urinal 350.

Figure 15:
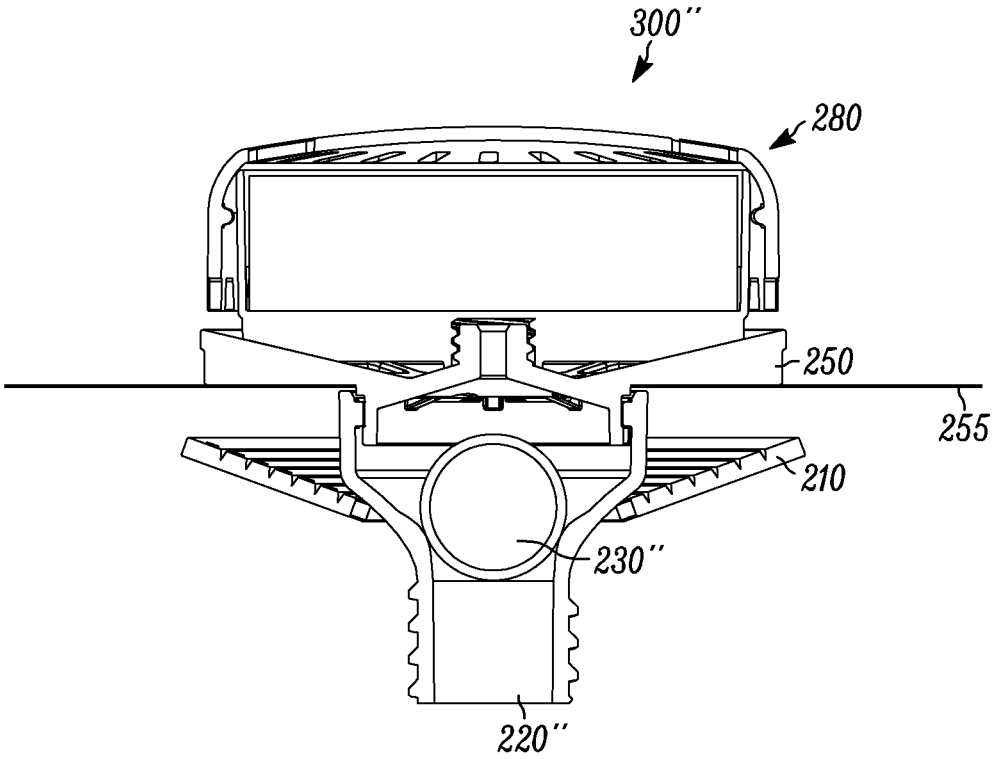
FIGS. 15-20 illustrate alternative embodiments of a fixture drain insert assembly in use with various types of traps.
Figure 16:
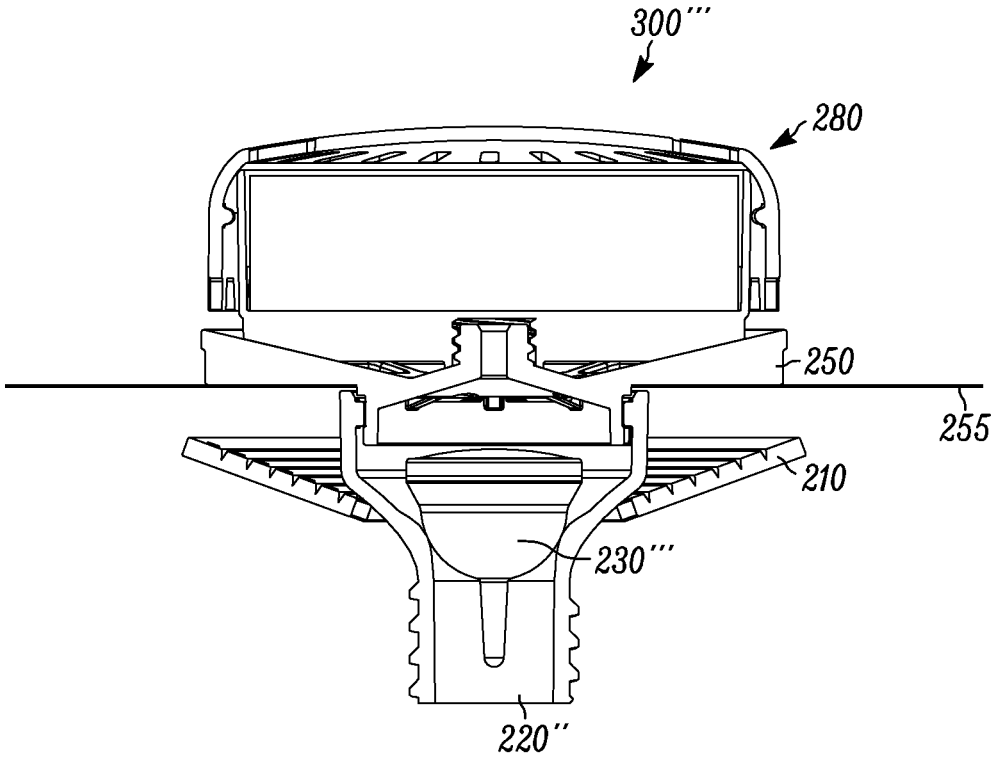
Figure 17:
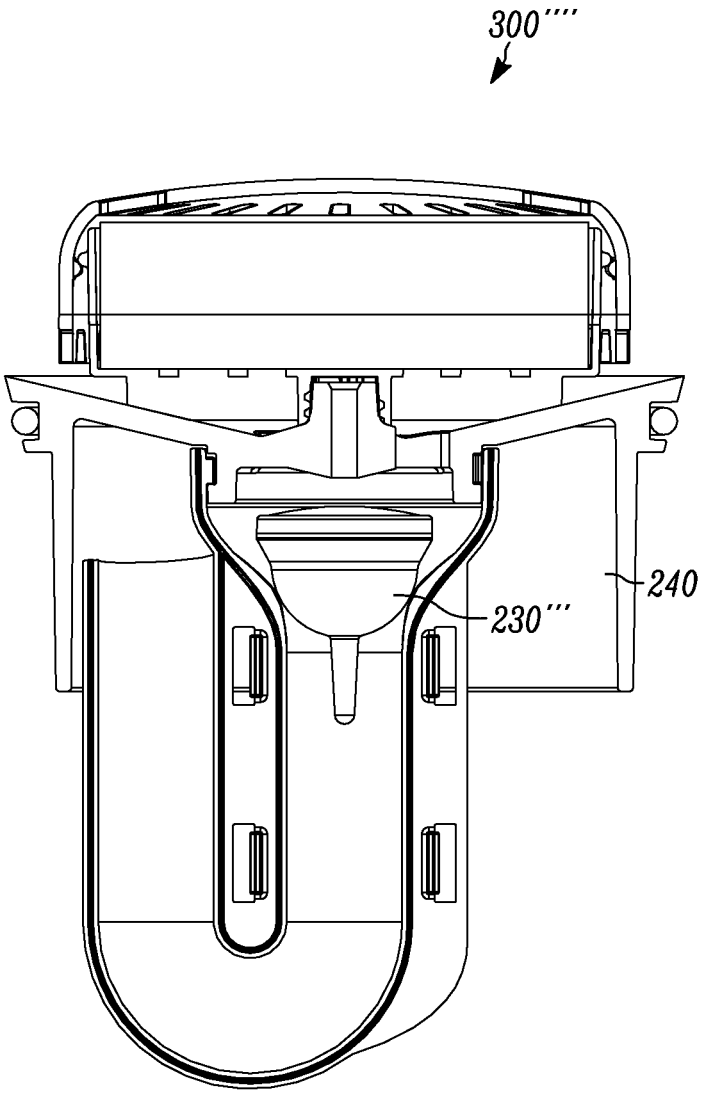

FIGS. 15-20 illustrate alternative embodiments of a fixture drain insert assembly. In FIG. 15, fixture drain insert assembly 300" is as shown in FIGS. 7-14, but uses a ball valve 230" instead of elastomer trap 230. In the exemplary embodiment shown, housing support 220" is threaded; however, it is to be understood that housing support 220 may be any shape or include threads or other securing structures to be configured for insertion into a given drain style. In the embodiment illustrated in FIG. 16 fixture drain insert assembly 300''' uses a bulb valve 230''' instead of elastomer trap 230. As illustrated in FIG. 17, different styles of valves (i.e., elastomer trap, ball valve, bulb valve) may be used with different styles of existing traps. In the embodiment shown in FIG. 17, fixture drain insert assembly 300" with bulb valve 230''' uses trap housing 240, as shown with FIGS. 1-6, and is shown in a J-trap design. However, it should be understood that the different fixture drain insert assembly embodiments (i.e., trap housing style and trap cover/drain cover skirt style) may be used with a variety of valves and therefore be configured for use in a variety of drain/trap styles.

Figure 18:
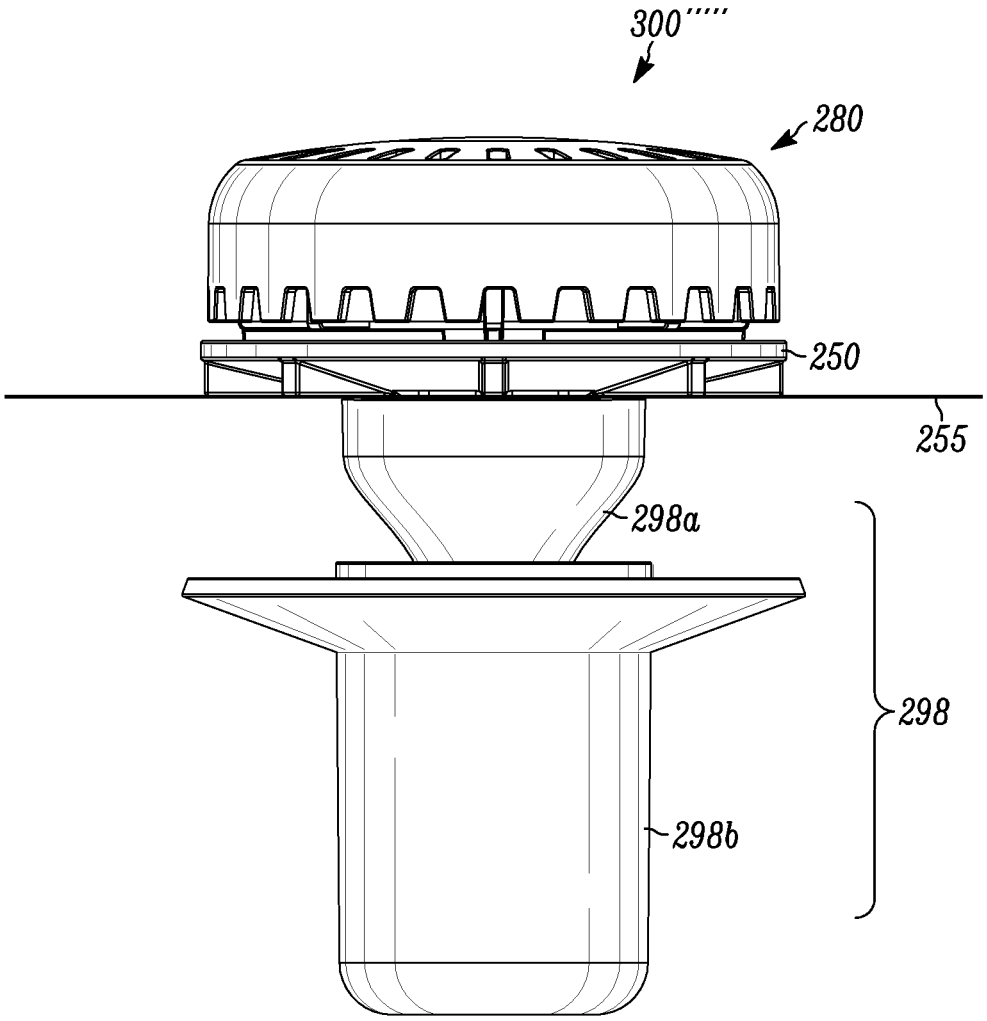
Figure 19:
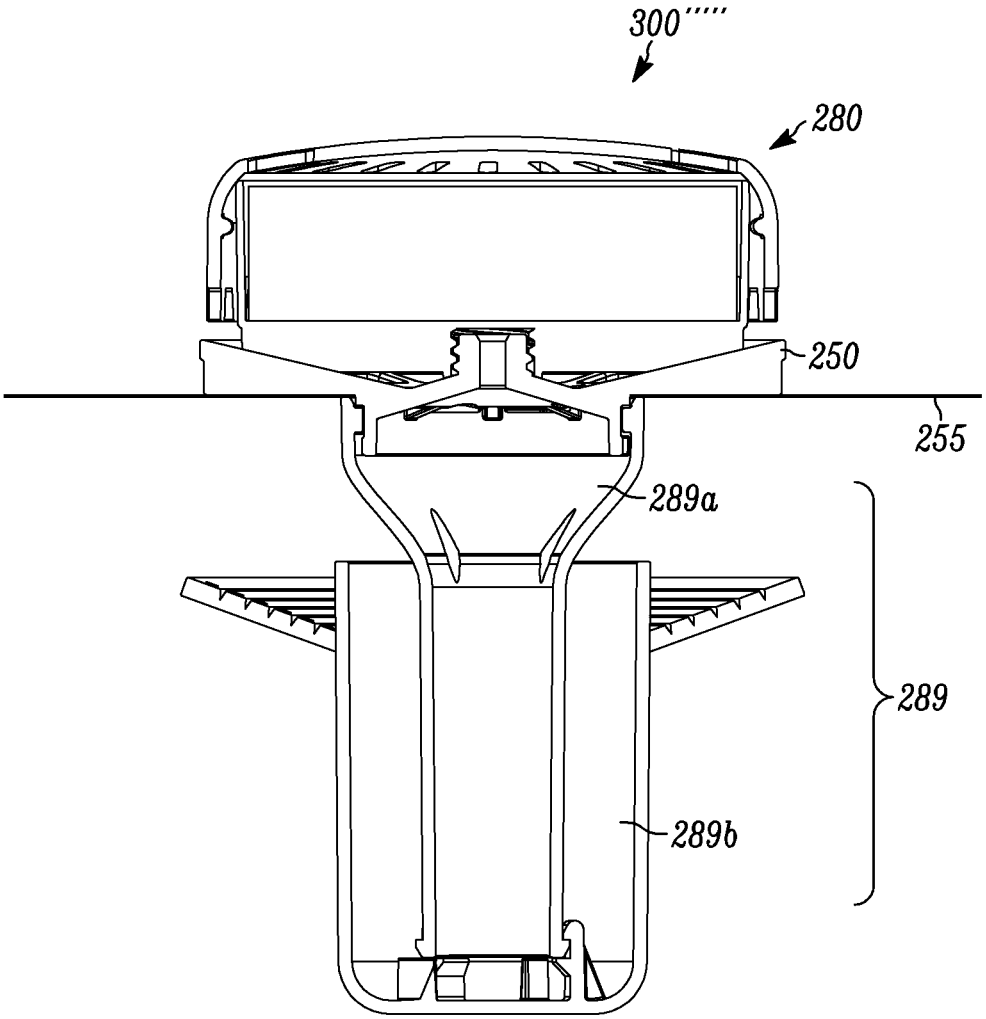
Figure 20:
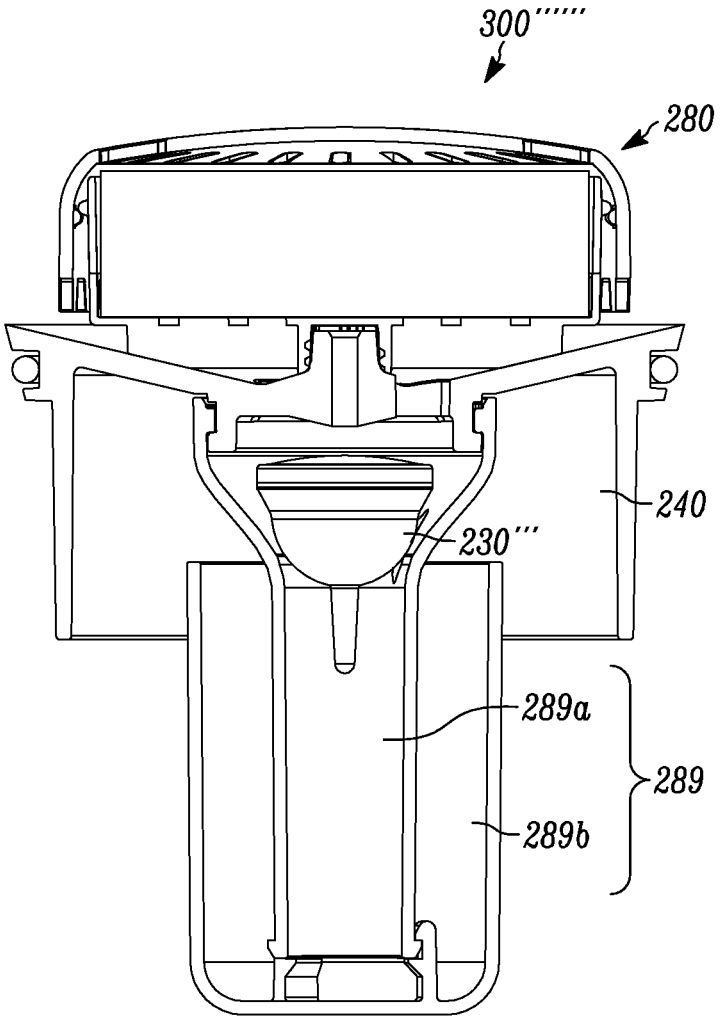

FIGS. 18-20 illustrate an exemplary fixture drain insert assembly 300'''' as used with a two-inch code valve (298*a*, 298*b*). The embodiment in FIGS. 16-17 uses a trap cover 250 with drain cover skirt 255, while the embodiment in FIG. 18 uses a trap housing 240 with a bulb valve 230'''.

In the exemplary embodiments described above, the embodiments of the fixture drain insert assembly are described for use with various valve, trap and drain styles. It is understood that assemblies described herein may be used with any valve and trap known in the art, including, but not limited to, elastomer valves comprising at least two flexible flaps, ball valves, bulb valves, two-inch code valves, J-traps, and S-traps.

It is specifically intended that the hygiene product disposal apparatus and method of use not be limited to the embodiments and illustrations contained herein, but include modified forms of those embodiments including portions of the embodiments and combinations of elements of different embodiments as come within the scope of the following claims.

We claim:

1. A fixture drain insert assembly comprising:

a material module support comprising a bottom surface with a securing component;

trap cover comprising an upper surface with a securing component corresponding to the securing component of the material support module, wherein the trap housing or trap cover further includes a plurality of drain apertures, an inner diameter with an external surface, and an interlocking structure on the external surface of the inner diameter;

a valve;

a gasket comprising a plurality of removable concentric rings and an inner edge having a plurality of drain apertures; and a cylindrical housing support comprising a cylindrical body with an open top end, the open top end comprising an interlocking structure and an inner lip on the inner surface of the open top end, wherein the interlocking structure corresponds to and mates with the interlocking structure of the trap housing or trap cover.

2. The assembly of claim 1 which further comprises a drain cover skirt.

3. The assembly of claim 1 wherein the trap cover further comprises a plurality of legs.

4. The assembly of claim 1 wherein the gasket is secured to the cylindrical housing support.

5. The assembly of claim 1 wherein the valve is an elastomer trap comprising an open top end and at least two flaps.

6. The assembly of claim 1 wherein the valve is selected from the group consisting of an elastomer trap, a bulb valve, a ball valve, and a two-inch code valve.

7. The assembly of claim 1 wherein the securing component of the material module is a threaded female member and the securing component of the upper surface of trap housing or trap cover is a threaded male member.

8. The assembly of claim 1 wherein the interlocking component of the cylindrical housing support and trap housing or trap cover is a plurality of protuberances together forming a bayonet mount.

9. A fixture drain insert assembly comprising:

a material support module comprising a cover and a bottom configured to secure together to house a material selected from the group consisting of a fragrance material, an enzyme material, a bacteria material, a cleaning material, and combinations thereof, and a female securing component on the bottom surface of the bottom;

a trap cover comprising a sloped upper surface containing a plurality of drain apertures and a central male securing component corresponding to the female securing component of the material support module, an inner diameter containing a plurality of interlocking L-shaped protuberances on an outer surface of the inner diameter, and a plurality of legs;

a housing support comprising an open end containing an inner lip and a plurality of protuberances on an inner surface of the open end, wherein the plurality of pin protuberances correspond to the plurality of interlocking L-shaped protuberances on the inner diameter of the trap housing, wherein the L-shaped protuberances of the inner diameter and the pin protuberances of the housing support are configured to matingly join as a bayonet mount, and a ridge;

a drain cover skirt secured between the housing support component and the trap cover;

a valve secured between the housing support and the trap cover and projecting into the housing support; and a gasket secured in the ridge of the housing support component, the gasket comprising a plurality of removable concentric rings and an inner edge having a plurality of drain apertures.

10. The assembly of claim 9 wherein the valve is selected from the group consisting of an elastomer valve comprising at least two flexible flaps, a ball valve, a bulb valve, a two-inch code valve, a J-trap, and an S-trap.

* * * * *